United States Patent [19]

Ostrowski

[11] Patent Number: 4,470,150

[45] Date of Patent: Sep. 4, 1984

[54] VOICE SYNTHESIZER WITH AUTOMATIC PITCH AND SPEECH RATE MODULATION

[75] Inventor: Carl L. Ostrowski, Mt. Clemens, Mich.

[73] Assignee: Federal Screw Works, Detroit, Mich.

[21] Appl. No.: 359,595

[22] Filed: Mar. 18, 1982

[51] Int. Cl.[3] ..... G10L 1/00

[52] U.S. Cl. ..... 381/52; 364/513.5

[58] Field of Search ..... 381/51–53, 381/36–40; 364/513.5

[56] References Cited

U.S. PATENT DOCUMENTS 3,704,345 11/1972 Coker et al. ..... 381/52

3,836,717 9/1974 Gagnon .

3,892,919 7/1975 Ichikawa ..... 381/51

3,908,085 9/1975 Gagnon .

4,128,737 12/1978 Dorais .

4,130,730 12/1978 Ostrowski .

4,264,783 4/1981 Gagnon .

4,278,838 7/1981 Antonov ..... 381/52

*Primary Examiner*—E. S. Matt Kemeny

*Attorney, Agent, or Firm*—Harness, Dickey & Pierce

[57] ABSTRACT

Understandability of synthesized speech is improved by random modulation: after a predetermined number of phonemes, the speech rate is changed by a random amount, with proportional changes in pitch and phoneme transition rate.

12 Claims, 5 Drawing Figures

VOICE SYNTHESIZER WITH AUTOMATIC PITCH AND SPEECH RATE MODULATION

BACKGROUND OF THE INVENTION

The present invention relates to simplified electronic voice synthesizers capable of producing quality speech and in particular to internal circuits therein for modulating pitch and speech rate.

In general, the present invention relates to voice synthesizers of the type disclosed in U.S. Pat. No. 4,128,727, issued Dec. 5, 1978, entitled "Voice Synthesizer," and in U.S. Pat. No. 4,130,730 issued Dec. 19, 1978, entitled "Voice Synthesizer," both of which have been assigned to the assignee of the present invention. Both of these patents disclosed voice synthesizers that phonetically synthesize human speech in response to sequence of digital input command words that identify a sequence of phonemes.

The U.S. Pat. No. 4,128,737 described a synthesizer capable of producing remarkably realistic sounding speech, which included control circuits responsive to input command words to vary the overall rate and volume of the speech generated, as well as the duration of each phoneme produced. In particular, each input command word consisted of twelve bits, seven of which were dedicated to phoneme selection to define a particular phoneme, pause, or control function, three of which were dedicated to inflection control, that is, varying the fundamental frequency or pitch of the voiced component of the phoneme, and two of which were dedicated to speech rate timing, that is, varying the normal time duration of the production of any given phoneme. With seven bits dedicated to phoneme selection, the synthesizer had the capacity to recognize $2^7$ or 128 different phonemes or commands. When these seven bits assumed one particular state, preferably 0000000, special decoder and control circuits within the synthesizer recognized the command word as a special instruction or flag command, rather than a phoneme selection command. The remaining five bits of flag command words were then decoded and directed to latch circuits which remembered their state. In particular, the two speech rate bits of the flag command word were directed to special flip-flop circuits which remembered the state of the bits until the next flag command was received. The output of these flip-flop circuits were then directed to speech rate modulation circuitry where they caused a relatively large adjustment in the speech rate in comparison to the effect of the speech rate control bits during a phoneme selection command. The two inflection control bits of the flag command were similarly directed to other flip-flop circuits and from there to pitch modulation circuits that modulated the over-all frequency of a series of phonemes. Thus, through use of a single command word, a computer or other device driving the voice synthesizer could set the over-all volume and rate of the synthesized speech for any desired number of phonemes following thereafter. When a device driving the synthesizer had been properly programmed to use flag command words, the synthesizer generates speech that is more natural sounding and much less monotonic than when the flag command words are not used to vary the rate and volume of the synthesized speech. The two speech rate timing bits and associated circuitry within the synthesizer disclosed in the U.S. Pat. No. 4,128,737 enables the external device driving the synthesizer to make minor changes in the normal duration of any given phoneme. These two bits provide four possible time intervals for each phoneme to be produced, one of the intervals being of normal duration, and the other three being minor variations thereof. These externally programmed rate bits enhance the ability of the synthesizer to generate extremely realistic-sounding speech by allowing the phonemes to be more contextually precise in time duration.

The U.S. Pat. No. 4,130,730 disclosed a speech synthesizer that is simpler in design, smaller in size, and less expensive than the one in the former patent, which nonetheless is capable of producing quality speech. The simplifications were made in part by using an eight bit command word to drive the latter synthesizer. Six bits of the command word are devoted to phoneme selection, which limits the maximum number of phonemes which can be synthesized to $2^6$ or 64. The remaining bits of the command word are dedicated to inflection control, which yields a maximum of four inflection control states: one normal state and three variations thereof. Absent from this synthesizer are some of the very features which gave the former synthesizer its sophistication and flexibility: the extra inflection control bit, the two phoneme timing control bits, and the flag command, decode, and control circuitry which enabled the former synthesizer to modulate the overall pitch and speech rate of the synthesized speech. As a result, the speech produced by the latter synthesizer is relatively monotonic and monospeed.

The synthesizer disclosed in the U.S. Pat. No. 4,130,730, however, incorporates a number of unique improvements into its circuits which help improve the quality of the synthesized speech in certain other ways in spite of the aforementioned reduction in sophistication and flexibility. For example, additional inflection variations are derived from internal control signals that control phoneme articulation; a glottal waveform that is more representative of those produced by the human glottis is employed; and a white noise generator is used to provide a component part of the excitation energy provided to the vocal tract under the control of the vocal amplitude control signal to produce a "breathier" sound. These improvements were made without significantly increasing the complexity or cost of the synthesizer. However, the problem with the monotonic and monospeed output remained.

The present invention seeks to maintain the tradition of creating simpler and less expensive synthesizers, while simultaneously improving upon the ultimate understandability of synthesized speech. Accordingly, the principal object of the present invention is to provide a relatively uncomplicated and inexpensive voice synthesizer which internally and automatically modulates pitch and speech rate. Another object of the invention is to provide fairly inexpensive circuitry for accomplishing the principal object within the type of synthesizer disclosed in the U.S. Pat. No. 4,130,730. Yet another object of this invention is to provide a method for improving the understandability of phonetically synthesized speech by providing a synthesizer that automatically varies the pitch and speech rate of the synthesized speech without resorting to the use of externally programmed input command bits.

Other objects, features and advantages of the present invention will become apparent from the subsequent description and the appended claims taken in conjunction with the accompanying drawings.

SUMMARY OF THE INVENTION

The overall organization and operation of the voice synthesizer disclosed herein is very similar to the voice synthesizer disclosed in U.S. Pat. No. 4,130,730, which has already been briefly discussed. The novel aspect of this synthesizer presented here relates to those circuits and signals within the synthesizer that modulate pitch and speech rate. To provide a better understanding of the operation of these novel features and circuits, the conventional circuits, signals, parameters and features of the present synthesizer will be briefly explained.

The preferred embodiment of the present invention comprises a system that is adapted to convert digitized data, such as the output from a computer or other digital device, into electronically synthesized speech by producing and integrating together the phonemes of speech identified by the digitized data. The basic digital command word which drives the present voice system preferably comprises eight bits. Six of these bits are dedicated to phoneme selection, thus providing a maximum of $2^6$ or 64 different phonemes. The remaining two bits are used for inflection control, which provides $2^2$ or four different inflection levels per phoneme.

The six phoneme selection bits are provided to an input control circuit which produces a plurality of predetermined control signal parameters that electronically define the phoneme selected. The control signals thus produced are preferably in the form of serialized binary-weighted square wave signals whose average DC values are equivalent to the analog control signals they represent. The use of such digital signals to represent analog signals in the present system avoids the necessity of employing significantly more complex analog multiplier circuitry to control the tuning and excitation of the vocal tract.

The control signal parameters from the input control circuit (with the exception of a timing control signal TM, and a transition rate control signal TRR, which will be explained later) are first passed through a series of relatively slow-acting transition filters which smooth the abrupt amplitude variations in the signals. From there, the control signals are provided to various dynamic articulation control circuits and excitation circuits which combine and process the signals to produce excitation control and vocal tract control signals analogous to the muscle commands from the brain to the vocal tract, glottis, tongue, and mouth in the human speech mechanism. Also produced by these circuits are vocal excitation signals that simulate the glottal waveform produced by vibrating human vocal cords, and fricative excitation signals that simulate the sound of air passing through a restricted opening as occurs in the pronunciation of such phonemes as "s," "f," and "h."

These vocal and fricative excitation signals, as well as the vocal control signals, are supplied to a series of cascaded resonant filters, herein called the vocal tract filters, which simulate the multiple resonant cavities in the human vocal tract. The control signals adjust the characteristic resonances of the filters to produce an audio signal having the desired frequency spectrum which simulates the human voice.

The present synthesizer employs a novel internal modulation circuit which automatically randomly varies or causes the variation of pitch, speech rate and transition rates of the transition filters in accordance with a modulation control signal produced by this circuit. Preferably, when the modulation control signal causes the pitch to increase, the speech rate and transition rates will be correspondingly increased, that is, made faster, by the modulation circuit. When the pitch is decreased, the speech rate and transition rates will be correspondingly decreased. This preferred interrelationship between pitch, speech rate and transition rates corresponds to the general pattern found in human speech of slightly raising pitch as speech rate increases, as generally happens for instance when a person gets excited while speaking. It is recognized, though, that pitch and speech rate could be independently varied if that were deemed desirable by simply duplicating some portions of the modulation circuitry revealed below.

In the particular embodiment of present invention described below, increasing the speech rate is accomplished by proportionally decreasing the timing of the phonemes, that is, the normal time periods of production for the phonemes. In order to maintain the smootheness of the transitions between phonemes in the synthesized speech when the speech rate is increased, the transition rates of the transition filters are correspondingly increased by proportionally decreasing the response time of the transition filters.

The modulation of pitch caused by the modulation control signal is preferably substantially random over a given frequency range in order to make the variations sound more natural than an ordered pattern of pitch modulation repeated at regular intervals would. The given frequency range is preferably small so as to make the modulations relatively subtle. Large variations in pitch have been found to sound quite unnatural and thus somewhat distracting to listeners.

The preferred embodiment of the present invention described in detail below shows the aforementioned modulation circuit comprised of, among other things, a counter circuit and a random generator. Basically, the counter is used to produce an output signal preferably after every eighth phoneme generated by the synthesizer. This output signal while present enables the random generator to assume a new state. The output of the random generator comprises the modulation control signal. As explained in detail later, the remaining circuitry within the modulation circuit is used to cause the pitch, speech rate and transition rates to vary in accordance with changes in the modulation control signal.

In reading the following detailed description of the preferred embodiment, it is to be understood that the practice of the present invention is not limited to the exact system described herein. Rather, the concepts of the present invention are equally applicable to other basic speech systems without departing significantly from the teachings of the present invention.

BRIEF DESCRIPTION OF THE DRAWINGS

FIG. 3 is a circuit diagram of a portion of a voice synthesizer according to the present invention illustrating how transition rates are modulated.

DETAILED DESCRIPTION OF THE PREFERRED EMBODIMENT

Figure 1A:
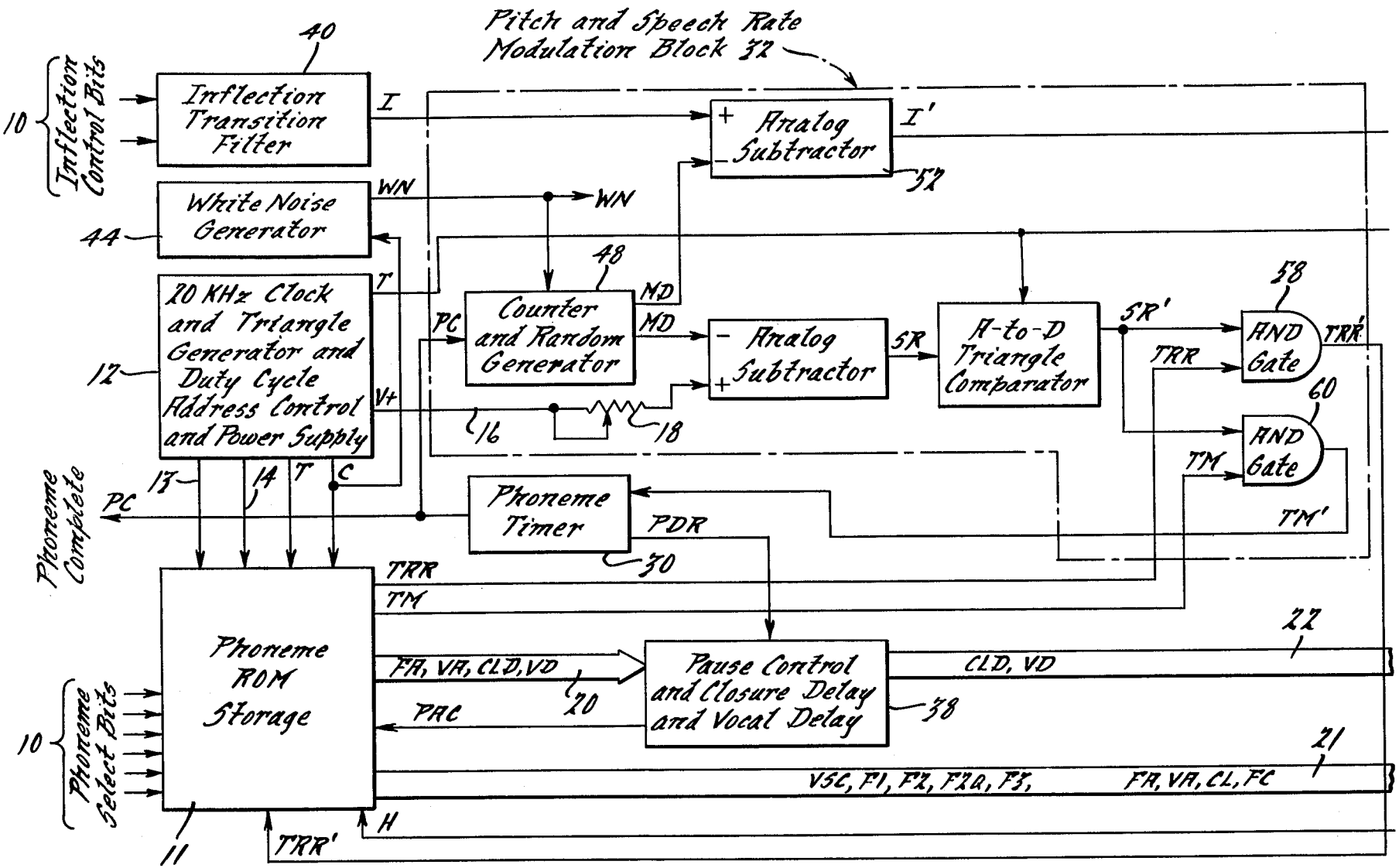
FIGS. 1A and 1B are a block diagram of a voice synthesizer according to the present invention.
Figure 1B:
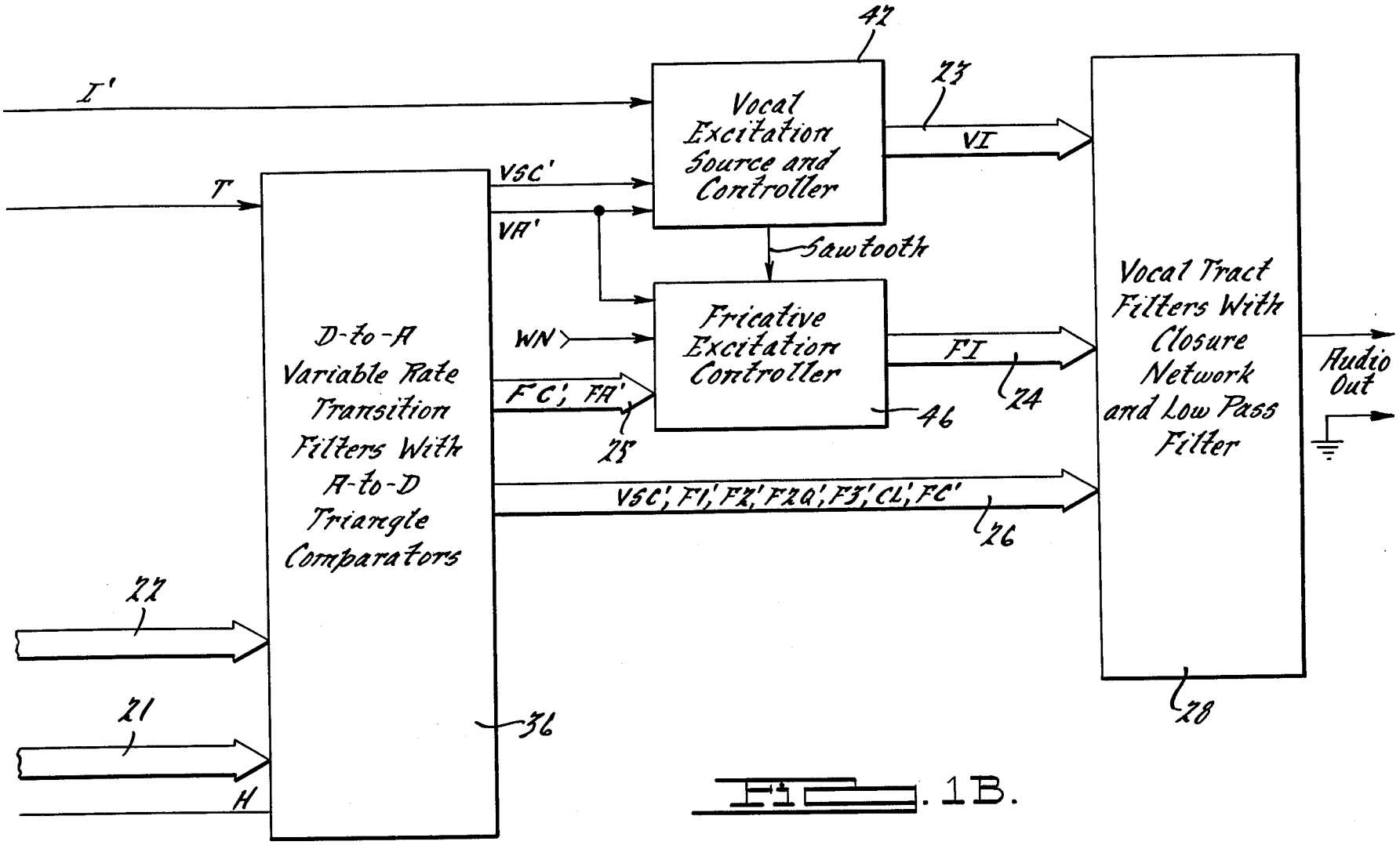

Looking to FIG. 1, a block diagram of a voice synthesizer embodying the teachings of the present invention is shown. It is to be understood that the practice of the present invention is not limited to the specific synthesizer shown in FIG. 1, but may be readily adapted to other systems without departing from the scope of the invention. As previously explained, the present system is preferably driven by an eight bit digital input command word 10. Six of the eight bits are used for phoneme selection and are provided to circuitry called phoneme ROM storage 11, which comprises read-only memories wherein fourteen different parameters which electronically define the articulation pattern for each of the sixty-four phonemes are stored. As previously mentioned, each parameter requires four bits of resolution to produce the serialized binary-weighted digital control signals whose average DC values are equivalent to the analog signals they represent. The first of the four bits is produced at a ROM storage output for eight time periods, the second of the four bits is produced at the same output for four time periods, the third bit is produced at the same output for two time periods and the last bit is produced at the same output for one time period. In this manner, the digital control signals have a DC average over fifteen time periods equal to the analog value which they represent. With four bits of resolution, each parameter has $2^4$ or 16 possible values. The phoneme ROM storage circuitry is clocked under the control of a duty cycle address circuit in block 12 which provides the proper timing sequence required to generate the serialized binary-weighted duty cycle parameter control signals via address signals 13 and 14. The duty cycle address control circuit is connected to and driven by a clock circuit in block 12 which produces a square wave output signal "C" having a frequency of 20 KHz. Also slaved off of the 20 KHz clock circuit is a triangle generator circuit, also in block 12, which produces a 20 KHz triangle waveform "T", whose use will be explained shortly. Block 12 also includes the obviously necessary power supply circuits to furnish power to all circuits as required by the various components. All normal and conventional power and ground connections have been omitted from FIGS. 1A, 1B, 2A and 2B for clarity, leaving only one line 16 shown connected between the power supply output terminal V+, which preferably is at five volts DC, and a rheostat 18 whose purpose will be explained later.

Although known to the art, the particular control signal parameters generated by ROM storage 11 will be briefly explained to provide a better understanding of the operation of the present system. For the sake of clarity, any time two or more signals run from one block to another block in FIGS. 1A and 1B, they are identified within a broad arrow as shown in broad arrows 20, 21, 22, 23, 24, 25 and 26.

The F1, F2 and F3 control signals determine the location of the resonant frequency poles in the first three cascaded resonant filters in the vocal tract filter circuitry within block 28.

The timing control signal TM is used to establish the basic period of production for each phoneme. In the synthesizer disclosed in U.S. Pat. No. 4,130,730, this timing signal ran directly to the phoneme timer circuit in block 30, since that synthesizer did not have any of the pitch and speech rate modulation circuitry shown within block 32, which is outlined by dashed lines. In the present invention, the information contained within the TM signal is modified by the circuitry within block 32 as will be explained in detail later.

The vocal amplitude control signal VA is generated whenever a phoneme having a voiced component is present to control the intensity of the voiced component in the audio output. The vocal delay control signal VD is generated during certain fricative-to-vowel phonetic transitions wherein the amplitude of the fricative component is rapidly decaying at the same time the amplitude of the vocal component is rapidly increasing. The VD signal is thus utilized to delay the transmission of the vocal amplitude control signal under such circumstances.

The closure control signal CL is used to simulate the phoneme interaction which occurs, for example, during the production of the phoneme "b" followed by the phoneme "e". In particular, the closure control signal is adapted to cause an abrupt amplitude modulation in the audio output that simulates the build-up and sudden release of energy that occurs during the pronunciation of such phoneme combinations. the vocal spectral contour control signal VSC is used to spectrally shape the energy spectrum of the vocal excitation signal. Specifically, the vocal spectral contour control signal controls a first order low pass filter in circuit block 42 that suppresses the vocal energy injected into the vocal tract, with maximum suppression occurring in the presence of purely unvoiced phonemes. The F2Q control signal varies the "Q" or bandwidth of the second order resonant filter in the vocal tract block 28, and is used primarily in connection with the production of the nasal phonemes "n," "m" and "ng". Nasal phonemes typically exhibit a higher amount of energy at the first formant (F1), and a substantially lower and broader energy content at the higher formants. Thus, during the presence of nasal phonemes, the F2Q control signal is generated to reduce the Q of the F2 resonant filter which, due to the cascaded arrangement of the resonant filters in the vocal tract will then prevent significant amounts of energy from reaching the higher formants.

The fricative amplitude control signal FA is generated whenever a phoneme having an unvoiced component is present and is used to control the intensity of the unvoiced component in the audio output. The closure delay control signal CLD is generated during certain vowel-to-fricative phonetic transitions wherein it is desirable to delay the transmission of the closure and fricative amplitude control signals in the same manner as that discussed in connection with the vocal delay control signal. Finally, a fricative control signal FC is provided which replaces two control signals normally provided in synthesizers of this type, i.e., the fricative frequency and fricative low pass control signals. Specifically, it has been determined that, when a fricative phoneme requires low frequency fricative energy in the range of the F2 formant, it does not also require a significant amount of high frequency fricative energy in the range of the F5 formant and vice versa. Thus, the synthesizer utilizes a single fricative control signal FC and the inverse of the FC control signal, $\overline{FC}$, to control the injection of both low and high frequency fricative energy into the vocal tract block 28.

The output control signal parameters from the ROM storage block 11 are applied to a plurality of relatively slow-acting transition filters in block 36. In actuality, the binary-weighted duty cycle control signals are effectively converted to analog signals by the transition filters, and then converted back to duty cycle digital signals by comparator amplifiers provided with a 20 KHz triangle clock signal T from the triangle generator block 12. The transition filters are purposefully designed to have a relatively long response time in relation to the steady-state duration of a typical phoneme so that the abrupt amplitude variations in the output control signals from ROM storage 11 will be eliminated. Thus, the transition filters provide gradual changes between the steady-state levels of the control signal parameters to simulate the smooth transitions between phonemes present in human speech.

The response times of the transition filters 36 utilized in the preferred embodiment of the present invention are variable under the control of the transition rate signal TRR' emanating from the pitch and speech rate modulation circuitry in block 32. The transition rate signal TRR emanating from phoneme ROM storage 11 in the present invention serves to control the transition rates of the transition filters 36 and thereby makes the transition rates more contextually precise for the phoneme currently being produced. In the present invention, this TRR signal is modified by the modulation circuitry in block 32 in proportion to the variations in the modulation signal to produce the TRR' signal in order to vary the transition rates in accordance with the modulations in pitch and speech rate.

The phoneme timer in block 32 is adapted to produce a phoneme duration ramp signal PDR that varies from five volts to zero volts in a time period that determines the duration for phoneme production. The slope of the PDR signal is determined by the phoneme timing control signal TM' from the pitch and speech rate modulation circuitry in block 32. In the synthesizer disclosed in U.S. Pat. No. 4,130,730, the phoneme timing control signal TM from phoneme ROM storage went directly to the phoneme timer. In the present invention, the phoneme timing signal TM is altered by the modulation circuitry 32 before being sent to the phoneme timer in order to vary the speech rate according to the modulation signal, as will be described in detail later.

The vocal delay control signal VD is provided to a vocal delay network in block 38 which is adapted to delay the transmission of the vocal amplitude control signal for a predetermined period of time less than the duration of a single phoneme time interval whenever the vocal delay control signal is provided by ROM storage 11. The closure delay network in block 38 functions similarly to the vocal delay network and is adapted to delay the transmission of the fricative amplitude and closure control signals whenever the closure delay control signal CLD is provided by ROM storage 11.

The two inflection select bits from the eight bit input command word 10 are provided directly to an inflection transition filter circuit in block 40 which combines the binary-weighted bits into a single analog signal, and then supplies the signal to a transition filter which smooths the abrupt amplitude variations in the signal in the same manner as that previously described with respect to the transition filters in block 36.

This transition filter has an output known as the inflection control signal I. The output from the inflection transition filter circuit 40 is provided directly to the vocal excitation source and controller 42 in conventional synthesizers. In the present invention, though, the modulation circuitry in block 32 alters the pitch under the control of the modulation signal, as will be fully explained later. The altered signal I' determines the pitch of the voiced component, which corresponds to the fundamental frequency (F$\phi$) of the glottal waveform.

The glottal waveform from the vocal excitation sources in block 42 has its energy content at various frequencies spectrally shaped in accordance with the vocal spectral contour signal VSC, and is modulated in amplitude in accordance with the vocal amplitude control signal VA.

The fricative excitation energy or unvoiced component of human speech is supplied by a white noise generator 44. Injection of the fricative excitation signals, collectively denoted FI in FIG. 1B, is controlled by the fricative excitation controller 46, which in turn operates under the control of the fricative amplitude control signal FA and fricative control signal FC which controls the injection of fricative excitation energy into the F2 and F5 resonant filters in the vocal tract 28. The output from the cascaded resonant filters is provided through a closure network and a low pass filter in block 28. The closure network is adapted to abruptly modulate the amplitude of the audio output signal in accordance with closure control signal previously described. The low pass filter serves to remove the effects of the 20 KHz clock signal from the audio output.

Figure 2A:
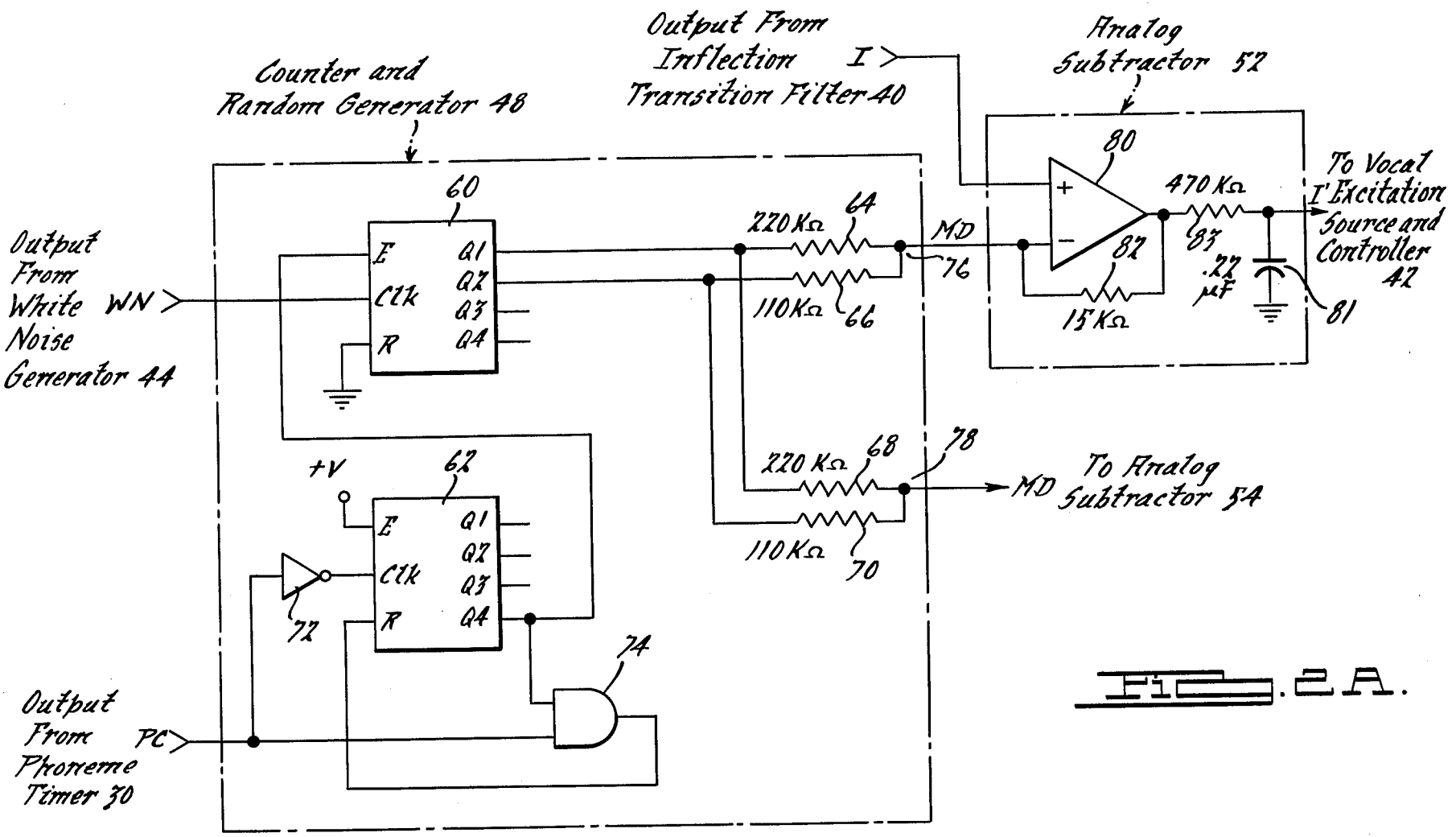
FIGS. 2A and 2B are a circuit diagram of the improved part of the system illustrated in FIG. 1.

Referring now to block 32 of FIGS. 1A and 1B, a detailed block diagram of the pitch and speech rate modulation circuitry therein is shown. As explained in a general way earlier, a counter circuit in block 48 counts each phoneme generated by the synthesizer via a phoneme complete signal PC, which emanates from the phoneme timer 30. This PC signal, which is normally high (5 VDC) goes low (0 VDC) momentarily to indicate the end of each phoneme production period. The counter counts the phonemes, and produces an output after a predetermined number of phonemes have been counted, preferably after every eighth phoneme. The counter output while present enables a random generator in block 48 to assume a new state. As is shown in FIG. 2A, the random generator is preferably comprised of a binary counter and a pair of resistors whose values are weighted to combine a plurality of low order outputs of binary outputs into a single analog signal whose average DC value reflects the current state of the binary counter. This analog signal is the modulation signal MD, shown as an output of block 48 in FIG. 1A. The random generator is driven by a white noise signal WN from the white noise generator 44, as shown in FIG. 1A. The white noise signal is a relatively high frequency source of random pulses. It clocks the random generator an indeterminate number of times while the random generator is enabled, thereby causing the output of the random generator to vary rapidly. The instant the random generator is no longer enabled, it freezes its output, thereby establishing a new state or value for the modulation signal MD.

The modulation signal is provided as a negative input to analog subtractors 52 and 54. Analog subtractor 52 receives the inflection control signal I as its positive input, and provides an output I', which represents the inflection control signal I reduced in value in proportion to the value of modulation signal MD.

Analog subtractor 54 receives as its positive input the power supply signal V+ modulated by rheostat 18, as shown in FIG. 1A and as will be further explained shortly. Basically, rheostat 18 provides a means for making manual adjustments to the speech rate of the synthesized speech. Analog subtractor 54 provides as an output a speech rate signal SR which is equivalent to the DC value of its positive input reduced by the modulation signal MD, and which is a DC value representing the desired speech rate. This SR signal is delivered as in input to an A-to-D triangle comparator 56. This comparator converts the analog SR signal into a digital speech rate signal SR', which is a variable pulse-width square wave signal whose percentage duty cycle corresponds to the DC average of the analog speech rate signal SR. As shown in FIG. 1, the triangle comparator 56 is driven by the 20 HKz triangular waveform T from block 12.

The SR' signal is fed to a pair of two input AND gates 58 and 60. AND Gate 58 receives as its other input the transition rate signal TRR from ROM storage 11. AND gate 60 receives as its other input the phoneme timing signal TM from ROM storage 11. Recall that all parameters, including the TM and TRR signals, from ROM storage 11 are outputted in the form of serialized binary-weighted digital control signals of four bit resolution over fifteen time period of a 20 KHz clock signal. The output of AND gate 58 is thus a pulse-width modulated version of the TRR signal known as the TRR' signal. Specifically, the SR' signal, whose frequency is fixed at 20 KHz, has caused the TRR signal, whose frequency is fifteen times slower, to be chopped into 20 KHz variable-width pulses via AND gate 58. The speech rate signal SR', thus digitally varies the average DC value of the TRR signal in accordance with its own average DC value. In the exact same manner, the speech rate signal SR' digitally varies the average DC value of the timing control signal TM via AND gate 60 to produce a timing signal TM'.

The TM' signal is provided as an input to the phoneme timer. Specifically, the TM' signal serves as an input signal to an integrated circuit within the phoneme timer that is built around an op amp which accumulates the total charge delivered by the TM' signal during the production of any given phoneme. When the accumulated charge reaches a certain predetermined level, the phoneme timer produces a phoneme complete pulse PC of short duration, and then resets the integrator by drawing off the accumulated charge. The phoneme complete pulse serves as an output or interrupt to the device driving the synthesizer. When the interrupt is received, the device delivers the next eight bit phoneme command word to the synthesizer. Upon receiving the new command word, the phoneme ROM storage block immediately begins outputting a new series of control signal parameters required to synthesize the phoneme selected.

Returning now to the pitch and speech rate modulation circuitry in block 32, notice that the outputs of analog subtractors 52 and 54 will vary inversely with the value of the modulation signal MD, since the MD signal is connected to the negative input of the subtractors. Thus, as the modulation signal MD increases, the inflection control signal I' will decrease, and the speech rate control signal SR' will decrease. In particular, lowering the value of I' lowers the pitch of fundamental frequency of the glottal waveform, and lowering the average DC value of SR' reduces the charge per unit time delivered to the phoneme timer via the timing control signal TM'. Similarly, the average DC value of the transition rate signal TRR' is also lowered, thus reducing the transition rates of the variable rate transition filters in block 36.

Figure 2B:
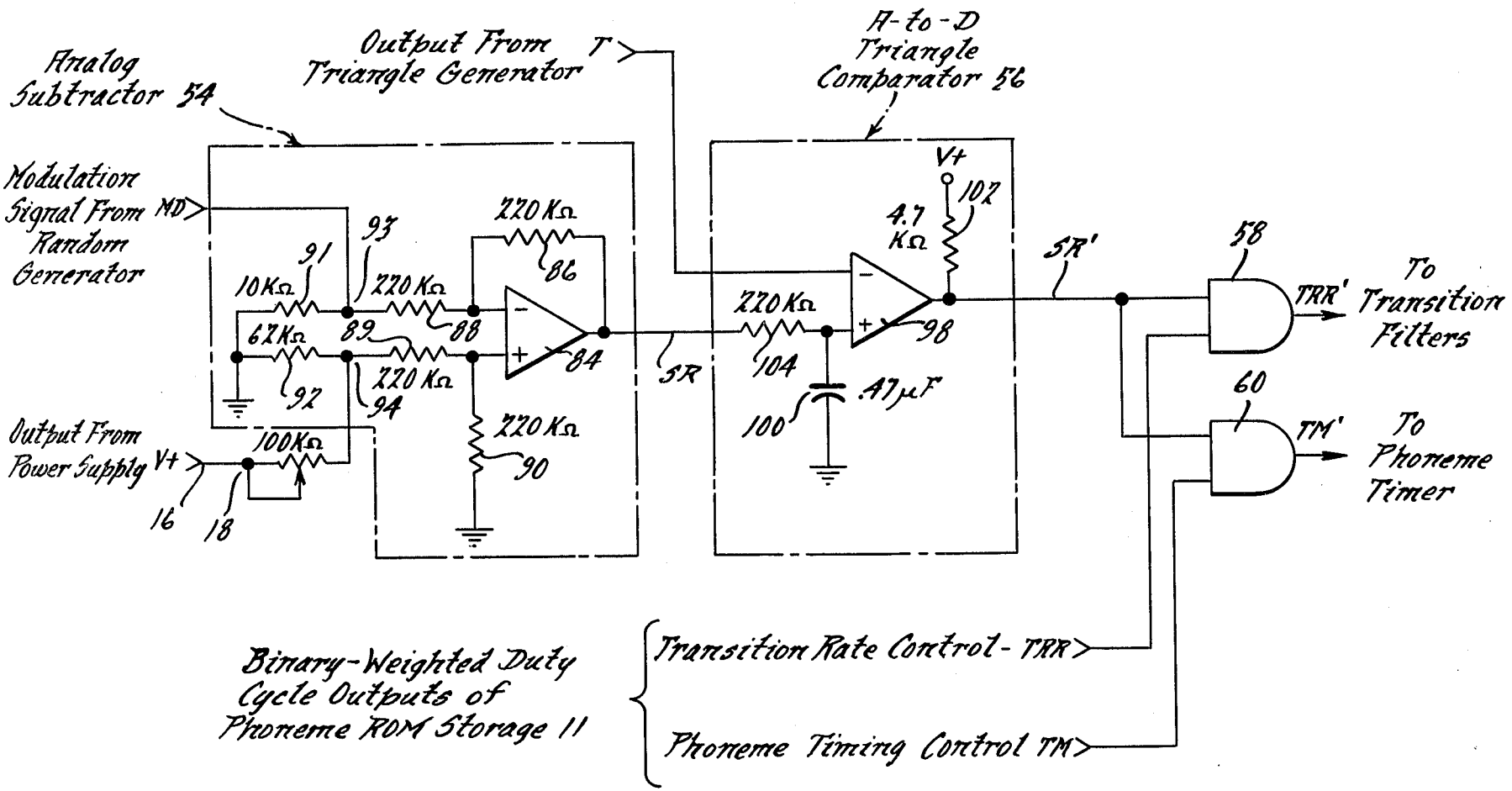

FIGS. 2A and 2B show a circuit diagram of the pitch and speed rate modulation block 32 illustrated in FIGS. 1A and 1B. Dashed lines in FIGS. 2A and 2B indicate which portions of the circuit diagram comprise the component blocks 48, 52, 54 and 56 of FIGS. 1A and 1B. Also, the preferred values of all resistors and capacitors used in the circuit shown in FIGS. 2A and 2B are given therein. The preferred integrated circuit components used to construct the circuit shown in FIGS. 2A and 2B are as follows: for counters 60 and 62, CMOS chip #4520, for amplifiers 80 and 84, an amplifier chip #3404, for amplifier 98, a linear amplifier chip #3302; for AND gates 58 and 60, a quad 2-input AND gate chip #4081; and for inverter 72, a CMOS chip #4069.

The counter and generator block 48 is comprised of two synchronous binary counters 60 and 62 each having four stages, four resistors 64, 66, 68 and 70, an inverter 72, and an AND gate 74, wired up as shown in FIG. 2A. Outputs Q1, Q2, Q3 and Q4 have a binary weight of 1, 2, 4 and 8 respectively. As shown in FIG. 2A, the clock input of counter 62 is connected to the output of inverter 72, which has its input the phoneme complete signal PC emanating from the phoneme timer 30. The PC signal, normally high, generates a negative pulse at the end of the production period of each phoneme. The enable input E of counter 62 is always high since it is tied to V+, the 5 volt DC supply source of the synthesizer. On account of AND gate 74, the reset input of counter 62 is low whenever output Q4 of counter 62 is low. Thus, counter 62 is enabled to count each pulse of PC signal, since counter 62 increments on the leading edge of the PC pulse. When the count equals eight, and the PC signal goes high, AND gate 74 produces an output to reset counter 62 to zero, which prepares counter 62 to count to eight again, without missing a clock pulse.

Output Q4 of counter 62 is high, then, only for the duration of the phonene complete pulse. When Q4 is high, counter 60 is enabled. Counter 60 is clocked by a high frequency white noise signal WN from the white noise generator 44 shown in FIG. 1A. While enabled, it is incremented an indeterminate number of times by pulses from the WN signal. When no longer enabled, counter 60 holds its count or state, since its reset input is always at logic 0, until enabled again. Counter 60 thus constitutes a random generator because each new state it will assume is unpredictable, at least from the perspective of one listening to the synthesized speech.

Outputs Q1 and Q2 of counter 60 are an ordered pair of digital signals having four possible values: 00, 01, 10 and 11. Through a pair of weighted resistors 64 and 66, these two digital outputs are combined to form an analog signal at node 76 whose DC value corresponds to the digital value of Q1 and Q2. In particular, the resistance of resistor 66 is that one-half that of resistor 64 in order to maintain the relative weights of each digital output vis-a-vis the other. The DC signal at node 76 is the modulation signal MD previously described. In the preferred embodiment, its value varies between four steady-state levels from 0 volts to 5 volts DC. Node 76, the MD signal, is connected to the analog subtractor block 52. In an identical fashion, a second pair of weighted resistors 68 and 70 are used to bring out the modulation signal MD to node 78, which is connected to analog subtractor 54. The use of the two aforementioned pairs of resistors effectively isolates the modulation signal going to analog subtractor 52 from the modulation signal going to analog subtractor 54.

Analog subtractor 52 is comprised of an amplifier 80, capacitor 81, feedback resistor 82 and series resistor 83 wired as shown in FIG. 2A to form a difference amplifier. The output I' of subtractor 52 represents signal I reduced by the modulation signal MD. Capacitor 81 and resistor 83 form a transition filter to smooth abrupt variations in the output of op am 82 caused by the modulation signal MD. This filter makes the slight changes in pitch produced by the pitch modulation circuitry sound more natural. The maximum variations in I' caused by MD are approximately 20% of the average value of I.

Figure 2:
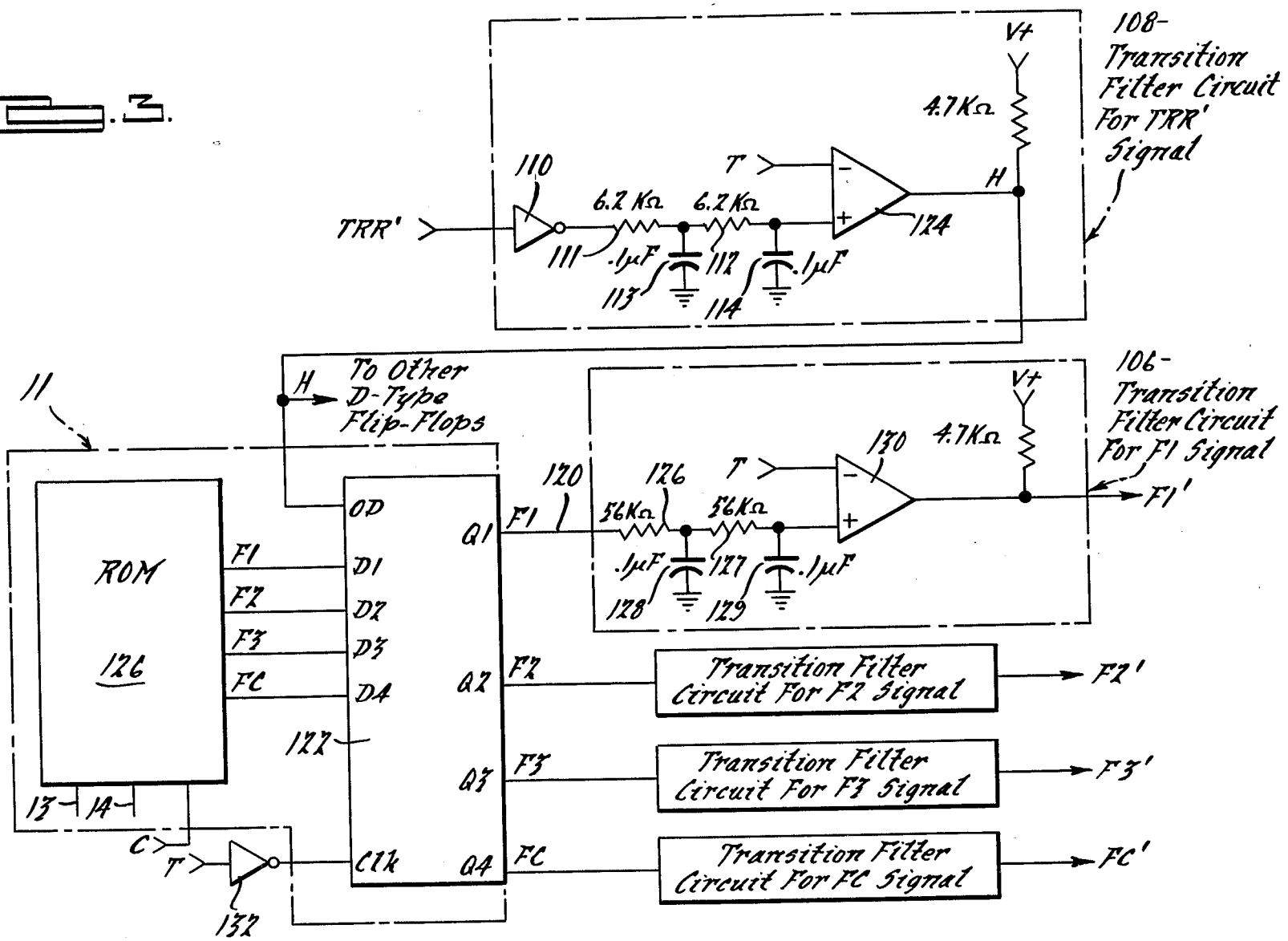

The modulation signal at node 78 is fed into analog subtractor 54 as shown in FIG. 2B. Analog subtractor 54 is comprised of amplifier 84, feedback resistor 86, and five resistors 88, 89, 90, 91 and 92. In the preferred embodiment, resistors 86, 88, 89 and 90 are all equal in value. In conjunction with amp 84, they form a conventional difference amplifier circuit having unity gain, and an output voltage equal to the difference between the voltages at nodes 93 and 94. Resistor 91 is in series with resistors 68 and 70 in the counter and random generator of block 48, and thus forms a voltage divider network. Similarly, resistor 92 forms a voltage divider network with rheostat 18. With the resistor values shown in FIG. 2, the voltage at node 93 is approximately 0.0 volts, 0.2 volts, 0.42 volts, and 0.65 volts when Q2 and Q1 of counter 60 are at values of 00, 01, 10 and 11 respectively. The voltage level of node 94 can vary from 0.0 to V+ or +5.0 volts. Hence, the voltage at node 93, which is determined by the modulation signal MD, will vary over a relatively small range in comparison to the values which can be established through rheostat 18 at node 94.

Rheostat 18 enables the overall speech rate of the voice synthesizer to be manually adjusted as desired to the speech rate which a listener finds easiest to understand.

As previously discussed, the output of the analog subtractor circuit 54 is the speech rate signal SR. The SR signal serves as the positive input to an A-to-D triangle comparator 56 built around operational amplifier 98. Other components in the triangle comparator circuit 56, which are wired as shown in FIG. 2B, include capacitor 100, pull-up resistor 102, and series resistor 104. Resistor 104 and capacitor 100 form a transition filter which smooths out abrupt changes in steady-state value of the speech rate signal SR. The negative input of the A-to-D triangle comparator is the triangle output T from the triangle waveform generator in block 12. The signal T has a frequency of 20 HKz and ramps up from 0 volts to 5 volts and ramps back down again every cycle. The amplifier 98 produces an output at approximately V+ volts whenever its positive input exceeds its negative input. Thus, the A-to-D triangle comparator transforms the analog speech rate signal SR into a digital speech rate signal SR' having a frequency of 20 KHz and having a duty cycle proportional to the analog value for the SR signal.

The SR' signal serves as an input to AND gates 58 and 60, and effectively varies the TRR and TM signals in accordance with the changes in the modulation signal, by chopping the TRR and TM signals into 20 KHz variable-width pulses, as previously explained. The resultant signals TRR' and TM' are sent to the phoneme timer 30 and transition filters 36 respectively as shown in FIGS. 1A and 1B, for purposes already discussed above.

The manner in which the TRR' signal modifies the transition rate of a transition filter in block 36 is illustrated in FIG. 3. All of the circuitry associated with the control signal parameter F1 in the preferred embodiment is shown in FIG. 3. Largely or completely omitted from FIG. 3 is the circuitry associated with the transition filters of other control signal parameters, since it is largely duplicative of the transition filter circuitry used for the F1 signal. Portions of ROM storage block 11 associated with other control signal parameters have been omitted as well. The preferred value of all resistors and capacitors used in the circuit shown in FIG. 3 are given therein. The preferred integrated circuit components used to construct the circuits shown in FIG. 3 are as follows: for comparators 124 and 130, a linear amplifier chip #3302; for inverters 110 and 132, a CMOS chip #4069; for quad flip-flop 122, a CMOS chip #4076; and for ROM 126, a #2716 chip.

In the preferred embodiment of the present invention, the TRR' signal has its own transition filter circuit in block 108. Upon being received by block 108, the TRR' signal is first inverted by inverter 110 for reasons which will be apparent shortly. Then, the signal from inverter 110 passes through a second order low pass filter, consisting of resistors 111 and 112 and capacitors 113 and 114, which converts the fifteen period pulse-width modulated signal from inverter 110 into an analog signal whose magnitude is proportional to the duty cycle of the digital signal from inverter 110. Triangle comparator 124 converts this analog signal back into a pulse-width modulated duty cycle signal called the hold signal H of 20 KHz frequency. The frequency of the H signal is determined by the frequency of triangular waveform T from block 12 fed to the negative inputs of comparator 124 and 130.

The four D-type flip-flops in chip 122 are synchronously loaded with data from ROM 126, since these four flip-flops share a common clock input CLK, which is connected indirectly via inverter 132 to the T signal from block 12. The 20 KHz clock signal C and address signals 13 and 14 from block 12 connected to ROM 126 cause new data to be placed on output lines F1, F2, F3 and FC of ROM 126. The T signal causes this data to be loaded into the four flip-flops of chip 122 via flip-flop inputs D1, D2, D3 and D4. The output disable input OD of chip 122 is connected to the H signal from comparator 124. When low, it permits flip-flop outputs Q1, Q2, Q3 and Q4 to assume the state of their respective internal flip-flops. When input OD is high, all four outputs assume a tri-state or open circuit condition irrespective of the state of their internal flip-flops.

The transition rate of any given transition filter shown in FIG. 3 is determined by how quickly the capacitors in the transition filter are charged or discharged by the input signal to the transition filter. For example, consider the transition filter circuit for the F1 signal shown in block 106. The circuit shown therein constitutes a D-to-A variable rate transition filter with an A-to-D triangle comparator. Capacitors 128 and 129 therein are charged and discharged by the input signal on line 120. In conjunction with resistors 126 and 127, capacitors 128 and 129 form a second order low pass filter, whose output is connected to the positive input of triangle comparator 130. Since the inputs of triangle comparator 130 have extremely high input resistances, capacitors 128 and 129 can only be charged or discharged through output Q1 of chip 122. Thus, the amount of time output Q1 remains in its open-circuit state, impeding both the charging and discharging of the low pass filter for the F1 signal, will influence the transition rate of the F1 signal transition filter.

As previously explained, the hold signal H is a 20 KHz digital signal whose duty cycle is inversely proportional to the average value of the TRR' signal on account of inverter 132. The average value of the TRR signal in turn is inversely proportional to the amplitude of the modulation signal MD. When the modulation signal is at its quiescent state or null point, the percentage duty cycle of the hold signal H will be determined the average value of the TRR signal from ROM storage 11 and the setting of rheostat 18. The percentage duty cycle of the H signal, then, will not be zero, but rather some given percentage. As the modulation signal MD increases, the percentage duty cycle of the hold signal H will also increase, thus retarding the transition rates of the transition filters, since the outputs of the D-type flip-flops will be held in their open-circuit state for a greater portion of each 20 KHz time period. Similarly, decreasing the MD signal results in lowering the percentage duty cycle of the H signal, which increases the transition rates. These changes in transition rates agree with variations in the pitch and speech rate caused by the MD signal, which have already been explained in detail above.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. An improved electronic voice synthesizer of the type having input circuit means responsive to input data identifying a sequence of phonemes for generating control and excitation signals that electronically define each phoneme in the sequence; and vocal tract circuit means responsive to said control and excitation signals for substantially producing the frequency spectrum of each phoneme in the sequence; wherein the improvement comprises:

means for automatically varying the pitch and timing of the phonemes independently of the input data to produce variations in the pitch and rate of the synthesized speech, wherein a change in the pitch of a given phoneme is accomplished by an inversely proportional change in the timing of that phoneme.

2. An improved electronic device for phonetically synthesizing human speech as recited in claim 1, wherein the automatic variations in pitch and timing of the phonemes are substantially random.

3. An improved electronic voice synthesizer of the type having input circuit means responsive to input data identifying a sequence of phonemes for generating control and excitation signals that electronically define each phoneme in the sequence, including variable rate transition circuits for smoothing the abrupt amplitude variations in at least some of said control signals which may occur during the transition from any given phoneme to the next phoneme in the sequence; and vocal tract circuit means responsive to said control and excitation signals from the input circuit means for substantially producing the frequency spectrum of each phoneme in the sequence; wherein the improvement comprises:

means for automatically varying the timing of the phonemes independently of the input data to produce variations in the rate of the synthesized speech; and means for varying the transition rates of the transition circuits in proportion to the variations in the rate of the synthesized speech.

4. An improved electronic voice synthesizer as recited in claim 3, wherein the automatic variations in the timing of the phonemes are substantially random.

5. An improved electronic device for phonetically synthesizing human speech of the type having input circuit means responsive to input data identifying a sequence of phonemes for generating control and excitation signals that electronically define each phoneme in the sequence, including an inflection control signal for controlling the inflection level of the synthesized speech and a timing control signal for establishing a basic period of production for each phoneme; and vocal tract means responsive to said control and excitation signals for substantially producing the frequency spectrum of each phoneme in the sequence; wherein the improvement comprises:

a pitch and speech rate modulation circuit adapted to automatically vary the pitch and rate of the synthesized speech wherein a change in the pitch of a given phoneme is accompanied by an inversely proportional change in the timing of that phoneme, including a random generator circuit adapted to produce a modulation signal and automatically alter the value of said modulation signal to a new random value after a number of phonemes have been synthesized, first circuit means for altering said inflection control signal in proportion to the value of said modulation signal, and second circuit means for altering said timing control signal so the basic period of production for each phoneme varies in inverse proportion to the value of said modulation signal.

6. An improved electronic device for phonetically synthesizing human speech of the type having input circuit means responsive to input data identifying a sequence of phonemes for generating control and excitation signals that electronically define each phoneme in the sequence, including a timing control signal for establishing a basic period of production for each phoneme; and vocal tract circuit means responsive to said control and excitation signals for substantially producing the frequency sprectrum of each phoneme in the sequence; wherein the improvement comprises:

speech rate modulation means for automatically varying the timing of the phonemes independently of the input data, including a random generator circuit adapted to produce a modulation signal and automatically alter the value of said modulation signal to a new random value after a number of phonemes have been synthesized, and circuit means for altering the timing control signal so the basic period of production for each phoneme varies in accordance with the value of said modulation signal.

7. An improved electronic device for phonetically synthesizing human speech of the type having input circuit means responsive to input data identifying a sequence of phonemes for generating control and excitation signals that electronically define each phoneme in the sequence, including an inflection control signal for controlling the inflection level of the synthesized speech; and vocal tract circuit means responsive to said control and excitation signals for substantially producing the frequency spectrum of each phoneme in the sequence; wherein the improvement comprises:

pitch modulation means for automatically varying the pitch of the phonemes independently of the input data, including a random generator circuit adapted to produce a modulation signal and automatically alter the value of said modulation signal to a new random value after a member of phonemes have been synthesized, and circuit means for altering the value of the inflection control signal in accordance with the value of said modulation signal.

8. An improved electronic device for phonetically synthesizing human speech as recited in claim 5, 6 or 7, wherein the random generator circuit comprises:

a counter that produces an output after a number of phonemes have been synthesized; and a random generator that produces the modulation signal and automatically alters the value of said modulation signal to a new random value whenever said counter produces an output.

9. An improved electronic device for phonetically synthesizing human speech, comprising:

input circuit means responsive to input data identifying a sequence of phonemes for generating control and excitation signals that electronically define each phoneme in the sequence, including variable rate transition circuits for smoothing out abrupt amplitude variations in some control signals which may occur during the transition from any given phoneme to the next phoneme in the sequence, and a control signal storage circuit provided with tri-state outputs connected to the variable rate transition circuits, said outputs being adapted to intermittently assume an open-circuit state;

vocal tract circuit means responsive to said control and excitation signals from the input circuit means for substantially producing the frequency spectrum of each phoneme in the sequence;

means for automatically varying the timing of the phonemes independently of the input data to produce variations in the rate of the synthesized speech; and means for varying the transition rates of the transition circuits in proportion to the variations in the rate of synthesized speech by altering the periods of time during which the tri-state outputs of the storage circuit are in an open-circuit state, thereby making the transition rates of the transition circuits correspond more precisely to the varying rate of the synthesized speech.

10. A method for modulating the pitch of phonetically synthesized speech, comprising:

sequentially generating a series of random values within a preselected range of values;

holding each value generated in the series while a number of phonemes are synthesized before generating the next value in the series of random values; and altering the normal pitch of each phoneme synthesized in accordance with the magnitude of the random value then held.

11. A method of modulating the speech rate of phonetically synthesized speech, comprising:

sequentially generating a series of random values within a preselected range of values;

holding each value generated in the series while a number of phonemes are synthesized before generating the next value in the series of random values; and altering the basic period of production of each phoneme synthesized in accordance with the magnitude of the random value then held.

12. A method for modulating the pitch and speech rate of phonetically synthesized speech, comprising:

sequentially generating a series of random values within a preselected range of values;

holding each value generated in the series while a number of phonemes are synthesized before generating the next value in the series of random values;

altering the normal pitch of each phoneme synthesized in proportion to the magnitude of the random value then held; and altering the basic period of production of each phoneme synthesized in inverse proportion to the magnitude of the random value then held.

* * * * *